US008768200B2

(12) United States Patent
Furuya et al.

(10) Patent No.: US 8,768,200 B2
(45) Date of Patent: Jul. 1, 2014

(54) TRANSFER UNIT AND IMAGE FORMING APPARATUS EMPLOYING THE TRANSFER UNIT

(75) Inventors: Masaharu Furuya, Yokohama (JP); Katsuhito Haruno, Sagamihara (JP); Takuya Sekine, Yokohama (JP); Ryoh Tanoue, Yokohama (JP); Masakazu Imai, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 620 days.

(21) Appl. No.: 12/499,332

(22) Filed: Jul. 8, 2009

(65) Prior Publication Data

US 2010/0008696 A1 Jan. 14, 2010

(30) Foreign Application Priority Data

Jul. 8, 2008 (JP) ..... 2008-178278
Jul. 18, 2008 (JP) ..... 2008-187063

(51) Int. Cl.
*G03G 15/16* (2006.01)
*G03G 15/08* (2006.01)

(52) U.S. Cl.
USPC ..... 399/101; 399/121

(58) Field of Classification Search
USPC ..... 399/101, 121
See application file for complete search history.

(56) References Cited

U.S. PATENT DOCUMENTS 5,923,936 A 7/1999 Tanoue et al.
6,173,148 B1 1/2001 Matsuda et al.
7,277,667 B2 10/2007 Saito et al.
2003/0099492 A1* 5/2003 Maeyama et al. ..... 399/302
2007/0172269 A1* 7/2007 Shiozawa ..... 399/313
2008/0112734 A1 5/2008 Furuya et al.
2008/0175621 A1 7/2008 Furuya et al.

FOREIGN PATENT DOCUMENTS

JP 09-222804 8/1997
JP 10020716 A * 1/1998 ..... G03G 21/00
JP 2000-29281 1/2000
JP 2003-98843 4/2003
JP 2003-228222 8/2003
JP 2004-177773 6/2004
JP 2004-177858 6/2004

(Continued)

OTHER PUBLICATIONS

U.S. Appl. No. 12/828,612, filed Jul. 1, 2010, Furuya, et al.

(Continued)

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

A transfer unit includes a belt member, a bending roller, a transfer section, and a bias application unit. The belt member is extended between rollers and has a movable surface on which a toner image is transferred from an image carrier. The bending roller externally contacts the surface of the belt member to bend the belt member and rotates in conjunction with the belt member. The transfer section includes one of the rollers and a surface moving member. The surface moving member rotates at least one full turn while cleaning is performed on the surface moving member and the bending roller. A surface moving speed of the bending roller is equal to or greater than a surface moving speed of the surface moving member. A circumferential length L1 of the surface moving member and a circumferential length L2 of the bending roller satisfy L1≥L2.

29 Claims, 5 Drawing Sheets

(56) References Cited

FOREIGN PATENT DOCUMENTS

| | | | | |
|---|---|---|---|---|
| JP | 2004-198680 | | | 7/2004 |
| JP | 2006072102 | A | * | 3/2006 |
| JP | 2007-140304 | A | | 6/2007 |
| JP | 2007-187943 | A | | 7/2007 |
| JP | 3984739 | | | 7/2007 |
| JP | 2007-199216 | | | 8/2007 |
| JP | 4003079 | | | 8/2007 |
| JP | 2007-286328 | A | | 11/2007 |
| JP | 2007-304335 | A | | 11/2007 |
| JP | 2007-316145 | | | 12/2007 |
| JP | 2008-083614 | | | 4/2008 |
| JP | 2008089749 | A | * | 4/2008 |

OTHER PUBLICATIONS

U.S. Appl. No. 09/118,891, filed Jul. 20, 1998, Chiemi Keneko, et al.

Japanese Office Action mailed on Nov. 9, 2012 in the counterpart Japanese patent application No. 2008-187063 filed on Jul. 18, 2008.

Japanese Office Action issued Jan. 25, 2013 in Patent Application No. 2008-187063.

Extended European Search Report issued on Sep. 6, 2012 in the counterpart European patent application No. 091647370.0.

Office Action issued on Jan. 24, 2014 in Japanese Patent Application 2013-095004 (3 Pages).

* cited by examiner

TRANSFER UNIT AND IMAGE FORMING APPARATUS EMPLOYING THE TRANSFER UNIT

CROSS-REFERENCE TO RELATED APPLICATIONS

The present patent application claims priority pursuant to 35 U.S.C. §119 from Japanese Patent Application Nos. 2008-178278, filed on Jul. 8, 2008, and 2008-187063, filed on Jul. 18, 2008 in the Japan Patent Office, the entire contents of each of which are hereby incorporated herein by reference.

BACKGROUND OF THE INVENTION

1. Field of the Invention

Illustrative embodiments of the present invention relate to a transfer unit and an image forming apparatus, such as a printer, a facsimile machine, and a copier, employing the transfer unit.

2. Description of the Background

Image forming apparatuses are used as copiers, printers, facsimile machines, and multi-functional devices combining several of the foregoing capabilities. One conventional image forming apparatus includes a transfer unit to transfer a toner image from an image carrier onto a recording sheet via a belt member serving as an intermediate transfer body. Typically, the belt member is extended around at least three rollers, such as a driving roller, a tension roller, and a speed control roller. Although only two of the three rollers excluding the speed control roller may be used, generally three or more rollers are used to obtain excellent image quality while suppressing color misalignment between different color toners. However, as the number of rollers increases, the space need for the belt member also expands, preventing satisfying recent market demand for more compact image forming apparatuses.

To meet such demand, one conventional transfer unit has been proposed that includes a bending roller pressed against an outer surface of a belt member looped around a plurality of rollers that bends the belt member toward the interior of the loop. Such a configuration can reduce the size of the belt member loop and, by so doing, provide increased flexibility in designing the layout of those devices that are positioned near the transfer unit.

However, in the conventional transfer unit described above, since the bending roller contacts the outer surface of the belt member, any residual toner remaining on the outer surface of the belt member without being transferred onto a recording medium may be conveyed to the bending roller and adhere to the outer surface of the bending roller.

Further, if such residual toner is fixed on the bending roller, the fixed toner may scratch the outer surface of the belt member when the bending roller and the belt member slide over each other, resulting in image failure and a reduced service life of the belt member.

SUMMARY OF THE INVENTION

The present disclosure provides a transfer unit having an enhanced cleaning capability and a reduced size and cost and an image forming apparatus employing the transfer unit.

In one illustrative embodiment, a transfer unit includes a belt member, a bending roller, a transfer section, and a bias application unit. The belt member is extended in a loop around a plurality of rollers and has a movable surface on which a toner image is transferred from an image carrier. The bending roller externally contacts the surface of the belt member to bend the belt member toward an interior of the loop and rotates in conjunction with moving of the surface of the belt member. The transfer section includes one roller of the plurality of rollers and a surface moving member. The one roller is located upstream the bending roller and downstream a transfer point at which the toner image is transferred from the image carrier onto the surface of the belt member in a surface moving direction of the belt member. The surface moving member faces the one roller of the plurality of rollers via the belt member. The transfer section transfers the toner image from the belt member onto a transfer material at a transfer nip formed by pressing the surface moving member against the one roller via the belt member. The bias application unit simultaneously applies a bias to both the transfer section and the bending roller to form an electric field to transfer toner adhering to the surface of the surface moving member from the surface moving member onto the belt member and an electric field to transfer toner adhering to a surface of the bending roller from the bending roller onto the belt member. The surface moving member rotates at least one full turn while cleaning is performed on the surface moving member and the bending roller by transferring the toner adhering to the surface of the surface moving member and the surface of the bending roller onto the belt member using the bias applied from the bias application unit to the transfer section and the bending roller. A surface moving speed of the bending roller is equal to or greater than a surface moving speed of the surface moving member. A circumferential length L1 of the surface moving member and a circumferential length L2 of the bending roller satisfy L1≥L2.

In another illustrative embodiment, an image forming apparatus includes an image carrier to carry a toner image and a transfer unit. The transfer unit includes a belt member, a bending roller, a transfer section, and a bias application unit. The belt member is extended in a loop around a plurality of rollers and has a movable surface on which the toner image is transferred from the image carrier. The bending roller externally contacts the surface of the belt member to bend the belt member toward an interior of the loop and rotates in conjunction with moving of the surface of the belt member. The transfer section includes one roller of the plurality of rollers and a surface moving member. The one roller is located upstream the bending roller and downstream a transfer point at which the toner image is transferred from the image carrier onto the surface of the belt member in a surface moving direction of the belt member. The surface moving member faces the one roller of the plurality of rollers via the belt member. The transfer section transfers the toner image from the belt member onto a transfer material at a transfer nip formed by pressing the surface moving member against the one roller via the belt member. The bias application unit simultaneously applies a bias to both the transfer section and the bending roller to form an electric field to transfer toner adhering to the surface of the surface moving member from the surface moving member onto the belt member and an electric field to transfer toner adhering to a surface of the bending roller from the bending roller onto the belt member. The surface moving member rotates at least one full turn while cleaning is performed on the surface moving member and the bending roller by transferring the toner adhering to the surface of the surface moving member and the surface of the bending roller onto the belt member using the bias applied from the bias application unit to the transfer section and the bending roller. A surface moving speed of the bending roller is equal to or greater than a surface moving speed of the surface moving member. A circumferential length L1 of the surface moving member and a circumferential length L2 of the bending roller satisfy L1≥L2.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein:

FIG. 11(*b*) is a diagram illustrating a contact area between the surface roller and the intermediate transfer belt;

FIG. 12(*b*) is a diagram illustrating a contact area between the surface roller and the intermediate transfer belt.

Figure 1:
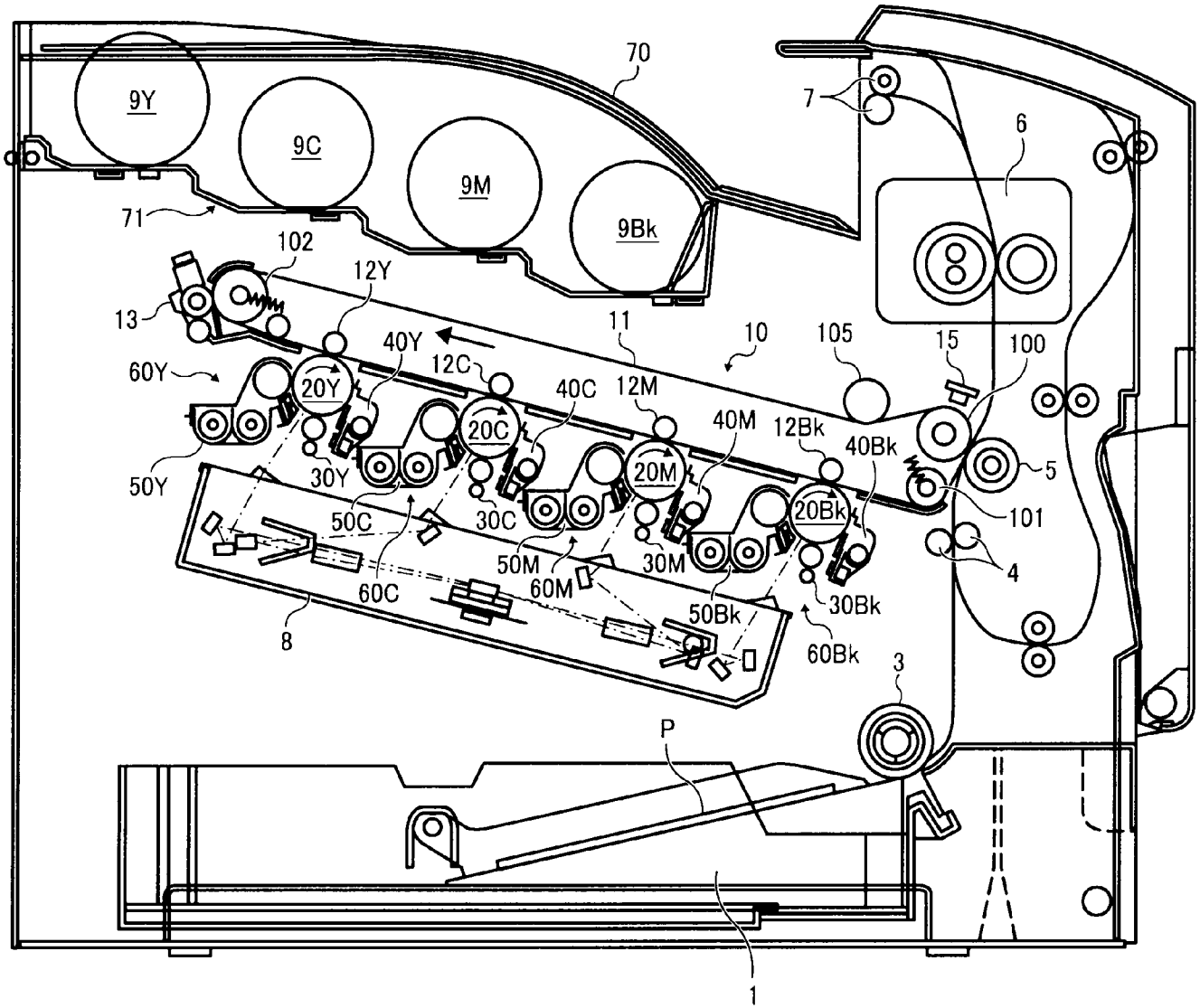
FIG. 1 is a schematic view illustrating a configuration of a printer serving as an image forming apparatus according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, an electrophotographic printer 1000 (hereinafter, a "printer") is described as an image forming apparatus according to an illustrative embodiment of the present disclosure. It is to be noted that the image forming apparatus is not limited to the electrophotographic printer and may be any other suitable type of image forming apparatus, such as another type of printer, a facsimile machine, a copier, or a multi-functional peripheral with several of the foregoing capabilities.

First, a basic configuration of the printer 1000 is described with reference to FIG. 1.

FIG. 1 is a schematic view illustrating a configuration of the printer 1000. In FIG. 1, the printer 1000 includes four process units 60Y, 60M, 60C, and 60Bk to form yellow, magenta, cyan, and black toner images, respectively. The process units 60Y, 60M, 60C, and 60Bk have similar, if not the same, configurations except that different color toners of Y, M, C, and Bk are employed. Each process unit is replaced with a new one at the end of its service life.

Below, the process unit 60Y for a yellow toner image is described as a representative example of the process units 60.

Figure 2:
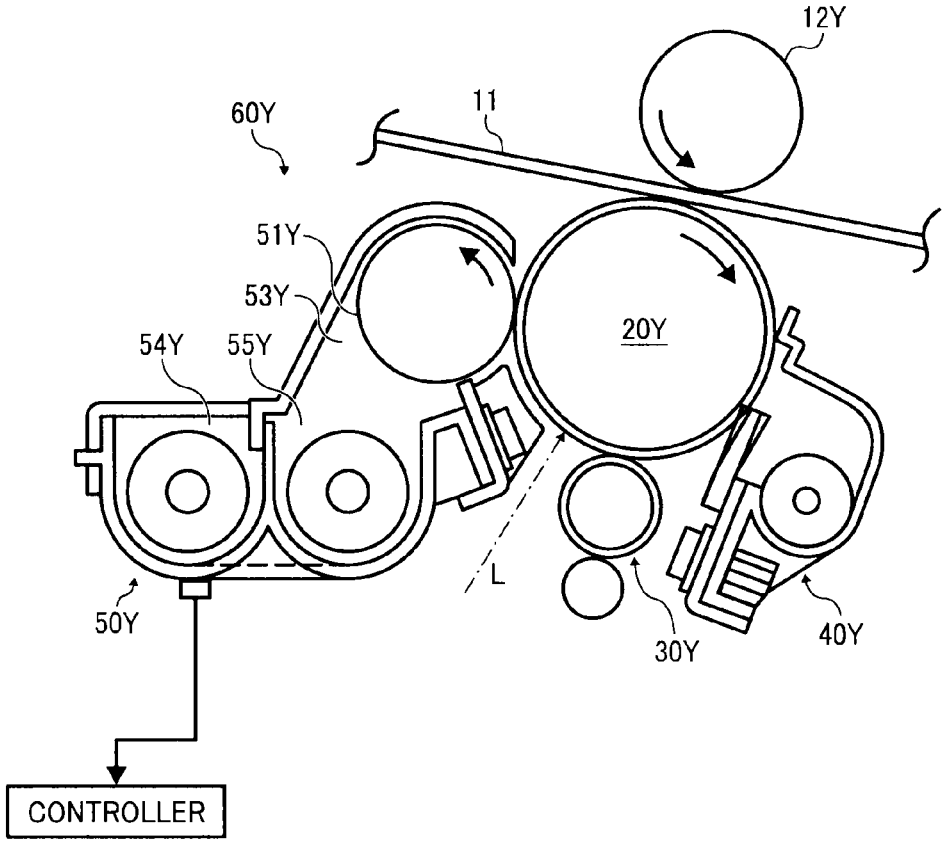
FIG. 2 is a schematic view illustrating a configuration of a process unit.

The process unit 60Y includes a drum-shaped photoconductor 20Y, a charger 30Y, a discharger (not illustrated), a drum cleaner 40Y, and a developing device 50Y, as illustrated in FIG. 2. Such devices are held as a single unit in a case and detachably mounted in a main body of the printer 1000.

The charger 30Y uniformly charges the surface of the photoconductor 20Y rotated by a driving device in a clockwise direction in FIG. 2. The uniformly-charged surface of the photoconductor 20Y is illuminated with a laser beam L from an optical writing unit 8 serving as a latent-image forming unit that carries an electrostatic latent image for yellow toner. The electrostatic latent image for yellow toner is developed using the developing device 50Y into a visible yellow toner image, which is then transferred onto the intermediate transfer belt 11.

The drum cleaner 40Y removes residual toner adhering to the surface of the photoconductor 20Y after the intermediate transfer process. The discharger removes residual charge remaining on the photoconductor 20Y after the cleaning to initialize (that is, prepare) the surface of the photoconductor 20Y in preparation for a subsequent image formation. Likewise, in the process units 60M, 60C, and 60Bk as well, magenta, cyan, and black toner images are respectively formed on the photoconductors 20M, 20C, and 20Bk and sequentially transferred onto the yellow toner image on the intermediate transfer belt 11. Thus, a composite four-color toner image is formed on the intermediate transfer belt 11.

The developing device 50Y has a developing section 53Y including a development sleeve 51Y, and a first compartment 54Y and a second compartment 55Y that accommodate yellow developing agent containing magnetic carriers and non-magnetic yellow toner. The non-magnetic yellow toner is charged with, for example, a negative polarity which is a normal charging polarity. The development sleeve 51Y includes a non-magnetic pipe rotated by a driving unit. In the developing section 53Y, a portion of the circumferential surface of the development sleeve 51Y is exposed to the outside from an opening in a development case. Thus, the photoconductor 20Y faces the development sleeve 51Y across a gap to form a developing area.

In FIG. 1, the optical writing unit 8 is disposed below the process units 60Y, 60M, 60C, and 60Bk. Four laser beams L emitted from the optical writing unit 8 based on image data optically scan the photoconductors 20Y, 20M, 20C, and 20Bk of the process units 60Y, 60M, 60C, and 60Bk. Thus, electrostatic latent images for yellow, magenta, cyan, and black are formed on the photoconductors 20Y, 20M, 20C, and 20Bk. In this regard, a laser beam emitted from a light source of the optical writing unit 8 is deflected in an axial direction of each photoconductor (i.e., a main scan direction) by regular-polygonal surfaces of a polygon mirror provided inside the optical writing unit 8 that is rotated by a motor, not shown. Thus, the optical writing unit 8 optically scans the photoconductors 20 in the main scan direction.

In FIG. 1, below the optical writing unit 8 is disposed a sheet-feed cassette 1 with a sheet-feed roller 3 provided at one end thereof. The sheet-feed cassette 1 accommodates a stack of sheets P, serving as recording media, with the sheet-feed roller 3 pressed against a top sheet P of the sheet stack. When the sheet-feed roller 3 is rotated by a driving unit, not shown, in a counter clockwise direction, the top sheet P is fed to a sheet-feed path.

Near one end of the sheet-feed path is disposed a pair of registration rollers 4. The sheet P fed into the sheet-feed path is sandwiched between the pair of registration rollers 4. On sandwiching the sheet P, the pair of registration rollers 4 temporarily stops rotating and resumes rotating to feed the sheet P toward a secondary transfer nip so that a composite four-color toner image is transferred onto the sheet P.

Figure 3:
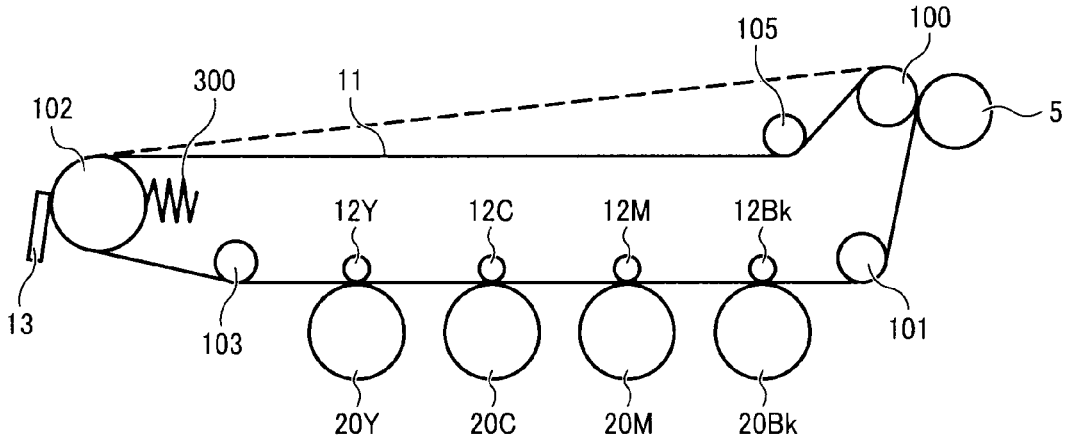
FIG. 3 is a schematic view illustrating a configuration of a transfer unit according to an illustrative embodiment of the present disclosure.

Above the process units 60Y, 60M, 60C, and 60Bk is disposed a transfer unit 10 that endlessly moves the intermediate transfer belt 11 in the counter-clockwise direction while keeping the tension on the intermediate transfer belt 11. As illustrated in FIG. 3, the transfer unit 10 includes primary transfer rollers 12Y, 12M, 12C, and 12Bk, a driving roller 100, an entry roller 101 and a roller 103 inside the loop of the intermediate transfer belt 11, and a tension roller 102 providing the intermediate transfer belt 11 with tension by being pressed by a spring 300. The intermediate transfer belt 11 is extended taut over these rollers and endlessly rotated by the rollers in the counter-clockwise direction in FIG. 3.

In this example, the entry roller 101 detects a belt speed of the intermediate transfer belt 11 using a speed detector. When the three extending rollers, that is, the driving roller 100, the entry roller 101, and the tension roller 102 are employed, the driving roller 100 is not used to detect the speed of the intermediate transfer belt 11 because it is not possible to perform feedback control based on the speed detection using the driving roller 100. Further, the tension roller 102 is not used to detect the speed of the intermediate transfer belt 11 because it is difficult to keep a constant distance between the speed detector and the tension roller 102 because the intermediate transfer belt 11 oscillates as it moves.

The primary transfer rollers 12Y, 12M, 12C, and 12Bk sandwich the intermediate transfer belt 11 with the photoconductors 20Y, 20M, 20C, and 20Bk, respectively. Thus, the photoconductors 20Y, 20M, 20C, and 20Bk contact the outer surface of the intermediate transfer belt 11 to form primary transfer nips for yellow, magenta, cyan, and black. A power supply supplies primary-transfer biases having a polarity (e.g., positive polarity) opposite a normal charging polarity (e.g., negative polarity) of the toner to the primary transfer rollers 12Y, 12M, 12C, and 12Bk.

When the intermediate transfer belt 11 sequentially passes the primary-transfer nips for yellow, magenta, cyan, and black, the Y, M, C, and Bk toner images on the photoconductors 20Y, 20M, 20C, and 20Bk are sequentially superimposed onto the intermediate transfer belt 11.

The transfer unit 10 further includes a secondary transfer roller 5 and a belt cleaner 13 outside the loop of the intermediate transfer belt 11. The secondary transfer roller 5 contacts the outer surface of the intermediate transfer belt 11 at a position facing the driving roller 100, which is disposed inside the loop of the intermediate transfer belt 11. When the composite four-color toner image on the intermediate transfer belt 11 enters the secondary transfer nip, the sheet P is fed from the pair of registration rollers 4 to the secondary transfer nip.

Figure 4:
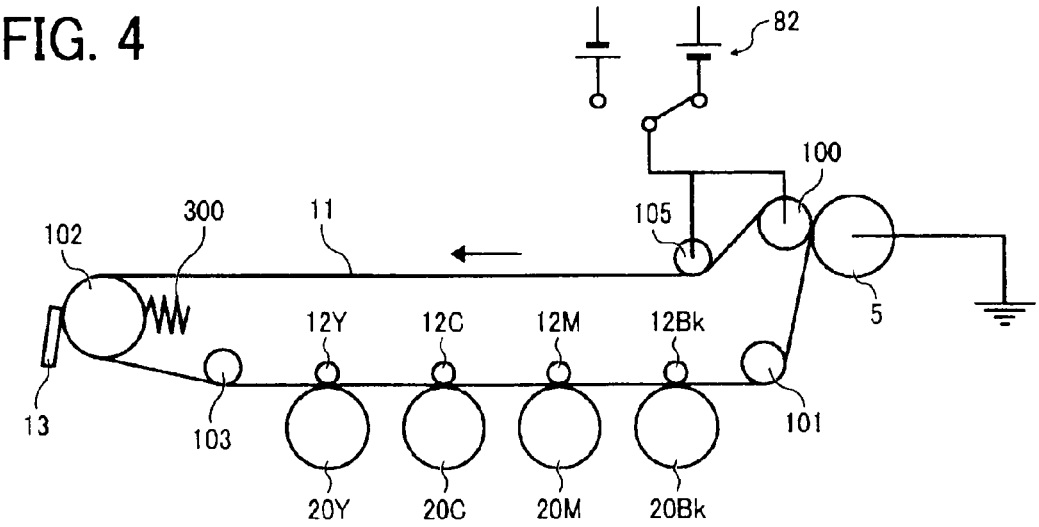
FIG. 4 is a schematic view illustrating a configuration of the transfer unit with a power supply to apply a bias to a surface roller and a driving roller.

To the driving roller 100 inside the loop of the intermediate transfer belt 11, a power supply 82 illustrated in FIG. 4 supplies a secondary transfer bias having the same polarity (e.g., negative polarity) as a normal charging polarity of toner. The secondary transfer roller 5 outside the loop of the intermediate transfer belt 11 is connected to ground. Thus, at the secondary transfer nip is formed a secondary-transfer electric field that moves toner from the intermediate transfer belt 11 toward the secondary transfer roller 5 by electrostatic force. When the sheet P contacts the composite four-color toner image on the intermediate transfer belt 11, the composite four-color toner image is collectively transferred onto the sheet P by action of the secondary transfer field and a nip pressure generated at the secondary transfer nip. Thus, the four colors of the composite toner image are combined with white color of the sheet P to form a desired full-color image.

As seen in FIGS. 1 and 3, the transfer unit 10 further includes a surface roller 105 serving as a bending roller that presses the intermediate transfer belt 11 toward the interior of the loop of the intermediate transfer belt 11. Thus, pressing the intermediate transfer belt 11 down using the surface roller 105 provides a reduced sectional area of the loop formed by the intermediate transfer belt 11 as compared to a hypothetical path of the intermediate transfer belt 11 indicated by a broken line in FIG. 3, allowing additional space-saving.

As described above, the surface roller 105 is disposed downstream of the driving roller 100 and upstream of the primary transfer nip for yellow in the rotation direction of the intermediate transfer belt 11. Such a configuration can prevent imaging failure, such as image distortion caused by unintended contact between the surface roller 105 and the composite toner image on the intermediate transfer belt 11 prior to the secondary transfer.

The surface roller 105 is rotated in conjunction with the rotation of the intermediate transfer belt 11. Such a configuration prevents the intermediate transfer belt 11 and the surface roller 105 from rotating at different speeds. If such a speed difference does arise between the intermediate transfer belt 11 and the surface roller 105, the surface roller 105 might damage the intermediate transfer belt 11. Hence, as described above, in the present illustrative embodiment, the surface roller 105 is configured to rotate in conjunction with the rotation of the intermediate transfer belt 11.

After the intermediate transfer belt 11 passes the secondary transfer nip, residual toner not transferred onto the sheet P may remain on the intermediate transfer belt 11. The belt cleaner 13 removes such residual toner from the surface of the intermediate transfer belt 11.

In FIG. 1, above the secondary transfer nip is disposed a fixing device 6. After the sheet P is separated from the intermediate transfer belt 11 and the secondary transfer roller 5 and fed out of the secondary transfer nip, the sheet P is sent to the fixing device 6. When the sheet P passes a fixing nip formed between a fixing roller including a heat source, such as a halogen lamp, and a press roller pressed against the fixing roller, the sheet P is heated and pressed to fix the full-color image on the surface of the sheet P.

The sheet P passes through a pair of ejection rollers 7 and is ejected to the outside of the image forming apparatus 7. On the upper face of the main body of the printer 1000 is formed a recessed stack portion 70 to accommodate the sheets of recording media P thus ejected, in which the sheets P ejected from the pair of ejection rollers 7 are stacked on the stack portion 70.

Between the transfer unit 10 and the stack portion 70 disposed above the transfer unit 10 is a bottle housing section 71 that houses toner bottles 9Y, 9M, 9C, and 9Bk containing Y, M, C, and Bk toners for refilling the developing devices with toner. Such Y, M, C, and Bk toners in the toner bottles 9Y, 9M, 9C, and 9Bk are supplied to the developing devices of the process units 60Y, 60M, 60C, and 60Bk using toner supply devices for Y, M, C, and Bk. The toner bottles 9Y, 9M, 9C, and 9Bk are detachable from the main body of the printer 1000 independently of the process units 60Y, 60M, 60C, and 60Bk.

Further, the printer 1000 performs process control to adjust image-forming parameters in response to fluctuations in ambient environment in order to properly maintain toner image density at proper levels. In such process control, the image-forming parameters are adjusted based on certain predetermined conditions, such as the cumulative number of printed sheets reaching a predetermined number.

In the adjustment of image-forming parameters during process control, for example, a P sensor 15 is employed as an optical sensor. A light beam emitted from a light-emitting element (e.g., a light emitting diode) of the P sensor 15 is reflected off a background area of the surface of the intermediate transfer belt 11 on which no toner is adhered. When the reflected light is received by a light-receiving element of the P sensor 15, the P sensor 15 outputs an output value corresponding to an intensity of the reflected light. This output value is used as a baseline value. Then, a solid pattern serving as a reference toner image having a predetermined shape is formed on the surface of a photoconductor 20 and then transferred onto the intermediate transfer belt 11. When a laser beam emitted from the light-emitting element is reflected on the solid pattern, the light-receiving element receives the reflected light and outputs a value corresponding to the reflected light. The above-described baseline output value in the background area of the surface of the intermediate transfer belt is compared with the output value in the reference toner image to determine a toner adhesion amount per unit area of the solid pattern (hereinafter simply "toner adhesion amount").

Based on the toner adhesion amount thus determined, control-target values regarding the potential for uniformly charging each photoconductor 20, development bias, transfer bias, optical writing intensity, and toner concentration of the developing agent are adjusted to obtain a desired toner-adhesion amount, i.e., image density. When an image density thus obtained falls in a predetermined range of image densities, the process control is finished. Such a configuration allows image formation at stable image densities over a relatively long term.

Conventionally, since a driving force relies only on a frictional force between an intermediate transfer belt and a surface roller, if a large amount of residual toner, which has not been transferred on a recording sheet P using a secondary transfer roller, adheres to the surface of the intermediate transfer belt, the frictional force arising at a contact portion of the intermediate transfer belt and the surface roller may weaken. As a result, the surface roller may slip on the intermediate transfer belt, preventing the surface roller from properly rotating in conjunction with the intermediate transfer belt. In particular, when the angle at which the intermediate transfer belt winds around the surface roller is not less than 40°, such a failure may easily occur. As described above, when the surface roller slips and does not properly rotate in conjunction with the intermediate transfer belt, a difference in speed arises between the surface roller and the intermediate transfer belt. Consequently, the intermediate transfer belt may be scratched by the scraping of the surface roller, reducing the service life of the intermediate transfer belt. Further, if the intermediate transfer belt is scratched, in the above-described process control, an inaccurate baseline output value may be obtained from the background portion of the intermediate transfer belt, preventing proper adjustment of image-forming parameters and resulting in image failure.

Hence, in the present illustrative embodiment, a bias having a predetermined polarity is applied to the surface roller 105 to electrostatically adhere the intermediate transfer belt 11 to the surface roller 105. Further, in the present illustrative embodiment, the surface roller 105 is made of a metal serving as a conductive material with a reliable electric-conduction capability. Using such a metal as the material of the surface roller 105 can provide not only a reliable electric-conduction capability but also a sufficient level of rigidity. Such a configuration can also reduce production cost. Further, a surface portion of the surface roller 105 may be made of a conductive foamed material or a conductive rubber material. Such a configuration allows electrical conduction while protecting the surface of the intermediate transfer belt 11, i.e., preventing the intermediate transfer belt 11 from being damaged by the surface roller 105. Alternatively, the surface portion of the surface roller 105 may be coated with a fluorocarbon resin, preventing adhesion of toner to the surface roller 105.

As described above, electrostatic attraction of the intermediate transfer belt 11 to the surface roller 105 prevents the surface roller 105 from slipping on the intermediate transfer belt 11, allowing the surface roller 105 to reliably rotate in conjunction with the surface roller 105. That is, even when the frictional force at the contact portion of the intermediate transfer belt 11 and the surface roller 105 is weakened by toner supplied between the intermediate transfer belt 11 and the surface roller 105, the electrostatic attracting force allows the surface roller 105 to reliably rotate in conjunction with the intermediate transfer belt 11.

As illustrated in FIG. 4, the power supply 82 also supplies a bias to both the surface roller 105 and the driving roller 100. Such a configuration can obviate the need for a dedicated power supply for supplying a bias to the surface roller 105, providing a reduction in both size and cost.

In addition, as illustrated in FIG. 4, when supplying a bias to the driving roller 100 and the surface roller 105, the power supply 82 switches a positive bias and a negative bias. In the present illustrative embodiment, when a toner image on the intermediate transfer belt 11 is transferred onto the recording sheet P at the secondary transfer nip, a negative bias having a polarity identical to a normal charging polarity of toner is applied to the driving roller 100 and the surface roller 105. Then, toner adhering to the secondary transfer roller 5 or the surface roller 105 is electrostatically transferred onto the intermediate transfer belt 11. When cleaning is performed on the secondary transfer roller 5 and the surface roller 105, the positive bias having a polarity that is the opposite of, and the negative bias identical to, the normal charging polarity are switched at a predetermined timing to be applied to the secondary transfer roller 5 and the surface roller 105.

In this regard, one reason for switching the polarity of the applied bias at a predetermined timing is as follows. That is, since generally toner is negatively charged, in removing toner adhering to the secondary transfer roller 5, a positive bias is applied to the driving roller 100 to electrostatically attract the toner from the secondary transfer roller 5 onto the intermediate transfer belt 11. Thus, the toner is transferred onto the intermediate transfer belt 11 and removed from the secondary transfer roller 5. However, when toner having the opposite polarity (toner charged with positive polarity) is adhered to the secondary transfer roller 5, applying the positive bias to the driving roller 100 does not cause the toner having the opposite polarity to be electrostatically attracted and transferred from the secondary transfer roller 5 onto the intermediate transfer belt 11. Consequently, the toner having the opposite polarity remains on the secondary transfer roller 5. Hence, in the present illustrative embodiment, by switching the bias applied to the driving roller 100 from the positive bias into the negative bias, the toner having the opposite polarity adhered to the secondary transfer roller 5 is electrostatically attracted and transferred from the secondary transfer roller 5 to the intermediate transfer belt 11, thus removing the toner having the opposite polarity from the secondary transfer roller 5.

Likewise, since generally toner is charged with a negative polarity which is a normal charging polarity, a negative bias is applied to the surface roller 105 to electrostatically transfer the toner from the surface roller 105 onto the intermediate transfer belt 11 to remove the toner from the surface roller 105. However, when the toner having the opposite polarity (i.e., the toner charged with positive polarity) is adhered to the surface roller 105, applying the negative bias to the surface roller 105 does not cause the toner having the opposite polarity to be electrostatically transferred from the surface roller 105 onto the intermediate transfer belt 11. Consequently, the toner having the opposite polarity remains on the surface roller 105. Hence, in the present illustrative embodiment, by switching the bias applied to the surface roller 105 from the negative bias to the positive bias, the toner having the opposite polarity adhering to the surface roller 105 is electrostatically transferred from the surface roller 105 onto the intermediate transfer belt 11, thus removing the toner having the opposite polarity from the surface roller 105.

In the present illustrative embodiment, on cleaning the secondary transfer roller 5 or the surface roller 105, the power supply 82 applies a positive bias to the driving roller 100 or the surface roller 105, switches the positive bias to a negative bias at a predetermined timing, and applies the negative bias to the driving roller 100 or the surface roller 105.

A description is now given of several configurations of the transfer unit of the present invention.

Configuration Example 1

When cleaning is performed on the secondary transfer roller 5, it is necessary to clean the surface of the secondary transfer roller 5 for one full turn or more by rotating the secondary transfer roller 5 one full turn or more. If the surface of the secondary transfer roller 5 is cleaned for less than one full turn, a portion of the surface of the secondary transfer roller 5 might remain uncleaned. In such a case, residual toner might be adhered to such an uncleaned portion and then to a back face (a sheet face facing the secondary transfer roller 5) of the recording sheet P fed into the transfer nip.

In the present configuration example, the diameter of the surface roller 105 is smaller than the diameter of the secondary transfer roller 5. In other words, the circumferential length L2 of the surface roller 105 is shorter than the circumferential length L1 of the secondary transfer roller 5. Further, the surface moving speed of the intermediate transfer belt 11, that is, the rotation speed of the surface roller 105 is set equal to or greater than the rotation speed of the secondary transfer roller 5. The secondary transfer roller 5 is configured to rotate in conjunction with the surface movement of the intermediate transfer belt 11, and the rotation speed of the secondary transfer roller 5 is set equal to the rotation speed of the surface roller 105.

Such a configuration allows the surface roller 105 to reliably rotate one full turn or more within the cleaning time of the secondary transfer roller 5 (a time period during which the secondary transfer roller 5 rotates one full turn or more). Thus, the surface of the surface roller 105 is cleaned for one full turn or more within the cleaning time so as not to leave an uncleaned portion across the surface of the surface roller 105 in the rotation direction of the surface roller 105, thus providing excellent cleaning of the surface roller 105.

Alternatively, the circumferential length L1 of the secondary transfer roller 5 may be equal to the circumferential length L2 of the surface roller 105. In such a case, when the secondary transfer roller 5 rotates one full turn, the surface roller 105 also rotates one full turn. Accordingly, when the surface of the secondary transfer roller 5 is cleaned over its full circumferential length, the surface of the surface roller 105 is cleaned over its full circumferential length.

That is, the relation between the circumferential length L1 of the secondary transfer roller 5 and the circumferential length L2 of the surface roller 105 satisfies the following Formula 1, providing excellent cleaning of the surface roller 105.

$$L1 \leq L2 \qquad \text{<Formula 1>}$$

Thus, when the cleaning of the secondary transfer roller 5 is finished, the cleaning of the surface roller 105 is also properly finished, preventing residual toner from being fixed on the surface roller 105 over time. Accordingly, such a configuration can prevent the intermediate transfer belt 11 from being damaged by such fixed toner when the surface roller 105 and the intermediate transfer belt 11 slide each other.

Configuration Example 2

In this configuration example, in addition to the configuration described in Configuration Example 1, the relation between the circumferential length L1 of the secondary transfer roller 5 and the circumferential length L2 of the surface roller 105 satisfies the following Formula 2.

$$L1 = L2 \times n \text{(where "}n\text{" is an integer of one or more)} \qquad \text{<Formula 2>}$$

In other words, the circumferential length L1 of the secondary transfer roller 5 is set to an integral multiple of the circumferential length L2 of the surface roller 105.

Further, in this example, the surface moving speed of the intermediate transfer belt 11, i.e., the rotation speed of the surface roller 105 is set equal to the rotation speed of the secondary transfer roller 5. The secondary transfer roller 5 is configured to rotate in conjunction with the surface movement of the intermediate transfer belt 11.

As described above, on cleaning the secondary transfer roller 5 or the surface roller 105, the power supply 82 applies a positive bias to the driving roller 100 or the surface roller 105, switches the applied bias from the positive bias to a negative bias at a predetermined timing, and applies the negative bias to the driving roller 100 or the surface roller 105. Thus, by applying the negative bias to the driving roller 100, toner having the opposite polarity (the positive polarity) is transferred from the secondary transfer roller 5 onto the intermediate transfer belt 11. After the cleaning, the toner having the opposite polarity is conveyed toward the surface roller 105 by rotation of the intermediate transfer belt 11 and removed from the intermediate transfer belt 11 using the belt cleaner. In such a case, when the toner having the opposite polarity passes through a contact portion between the surface roller 105 and the intermediate transfer belt 11, a portion of the toner having the opposite polarity may adhere onto the surface of the surface roller 105. In a subsequent image formation, when a toner image on the intermediate transfer belt 11 is transferred onto the recording sheet P at the secondary transfer nip, the power supply 82 applies a negative bias to the driving roller 100 and the surface roller 105 to electrostatically transfer such a portion of the toner having the opposite polarity from the surface roller 105 onto the intermediate transfer belt 11. Accordingly, even if a portion of the toner having the opposite polarity adheres to the surface roller 105 after the cleaning, the above-described configuration allows such a portion of toner to be removed from the surface roller 105. Further, repeating such an operation can prevent toner from accumulating on the surface roller 105 over time.

Figure 5:
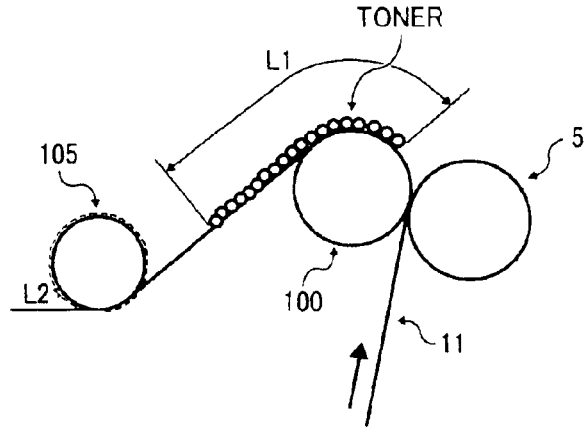
FIG. 5 is an enlarged view of an area around the surface roller and a secondary transfer nip in a configuration of the transfer unit.

In this regard, as illustrated in FIG. 5, the toner having the opposite polarity transferred from the secondary transfer roller 5 onto the intermediate transfer belt 11 is adhered over a length identical to the circumferential length L1 of the secondary transfer roller 5 in the rotation direction of the intermediate transfer belt 11. In such a case, when the circumferential length L1 of the secondary transfer roller 5 is equal to an integral multiple of the circumferential length L2 of the surface roller 105 as in this example, the toner having the opposite polarity passing through the contact portion between the surface roller 105 and the intermediate transfer belt 11 after the cleaning may be adhered to the surface of the surface roller 105 in units of the full circumferential length of the secondary transfer roller 5. Such a configuration prevents the toner having the opposite polarity from unevenly adhering to a portion of the surface of the surface roller 105. Accordingly, the cleaning of the surface roller 105 is effectively performed, preventing toner from fixing on the surface roller 105 over time.

Configuration Example 3

In this example, in addition to the configuration described in Configuration Example 1, when cleaning is performed on the secondary transfer roller 5 and the surface roller 105, the surface moving distance D1 in which the secondary transfer roller 5 moves while the power supply 82 supplies a bias to the secondary transfer roller 5 and the surface roller 105 is set to satisfy the following Formula 3.

$$D1=L1\times n \text{(where "}n\text{" is an integer of two or more)} \quad \text{<Formula 3>}$$

In this example, the time period during which the power supply 82 supplies a bias to the driving roller 100 and the surface roller 105 in cleaning the driving roller 100 and the surface roller 105 is set to a time period during which the secondary transfer roller 5 rotates two full turns. In such a case, since the secondary transfer roller 5 having the circumferential length L1 rotates two full turns during the time period, n=2 is substituted into Formula 3. As a result, the surface moving distance D1 of the secondary transfer roller 5 during the time period is twice the circumferential length L1 of the secondary transfer roller 5. Accordingly, the toner transferred from the secondary transfer roller 5 onto the intermediate transfer belt 11 during the time period is adhered over a length twice the circumferential length L1 of the secondary transfer roller 5. In this regard, in the first rotation of the secondary transfer roller 5, the power supply 82 supplies a positive bias to remove the toner having negative polarity from the secondary transfer roller 5. In the second rotation, the power supply 82 supplies a negative bias to remove the toner having positive polarity from the secondary transfer roller 5.

Figure 6:
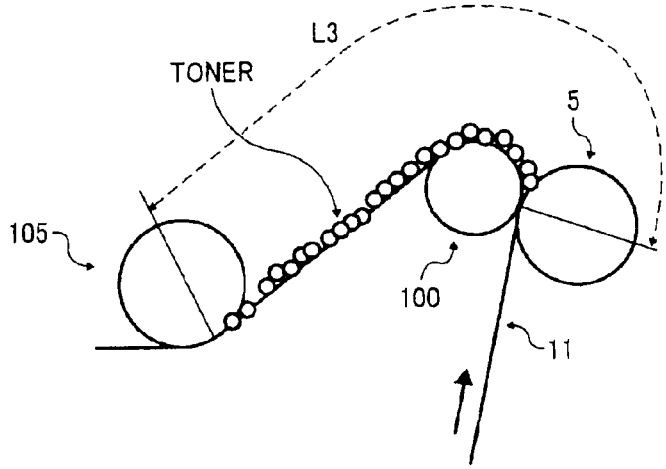
FIG. 6 is an enlarged view of an area around the surface roller and the secondary transfer nip in a configuration of the transfer unit.

As illustrated in FIG. 6, the distance L3 from the contact position between the secondary transfer roller 5 and the intermediate transfer belt 11, on the one hand, to the contact position between the surface roller 105 and the intermediate transfer belt 11 toward the downstream side in the surface moving direction of the intermediate transfer belt 11 on the other, satisfies the following Formula 4. In this configuration example, since n=2 is satisfied as described above, L3=L1 is obtained from the following Formula 4.

$$L3=D1\times(n-1)/n=(n-1)\times L1 \text{(where "}n\text{" is an integer of two or more.)} \quad \text{<Formula 4>}$$

Thus, when cleaning is performed on the secondary transfer roller 5 and the surface roller 105, the toner having negative polarity transferred from the secondary transfer roller 5 onto the intermediate transfer belt 11 in the first rotation of the secondary transfer roller 5 is conveyed toward the surface roller 105 by rotation of the intermediate transfer belt 11. When the front end of the toner arrives at the surface roller 105, the cleaning for the first rotation of the secondary transfer roller 5 is finished. Subsequently, the cleaning for the second rotation of the secondary transfer roller 5 is started. At that time, since the power supply 82 applies a negative bias to the surface roller 105, when the toner having negative polarity on the intermediate transfer belt 11, which has been removed from the secondary transfer roller 5, starts contacting the surface roller 105, the toner is electrostatically repulsed from the surface roller 105. Further, the power source 82 continuously applies the negative bias to the surface roller 105 until the rear end of the toner passes the surface roller 105. Such a configuration prevents the toner having negative polarity, which has been removed from the secondary transfer roller 5, from adhering to the surface roller 105.

Alternatively, the distance L3 from the contact position between the secondary transfer roller 5 and the intermediate transfer belt 11 to the contact position between the surface roller 105 and the intermediate transfer belt 11 toward the downstream side in the surface moving direction of the intermediate transfer belt 11 may be set to satisfy the following Formula 5.

$$L3<D1\times(n-1)/n<(n-1)\times L1 \text{(where "}n\text{" is an integer of two or more)} \quad \text{<Formula 5>}$$

Such a configuration also prevents the toner removed from the secondary transfer roller 5 from adhering to the surface roller 105.

Figure 7:
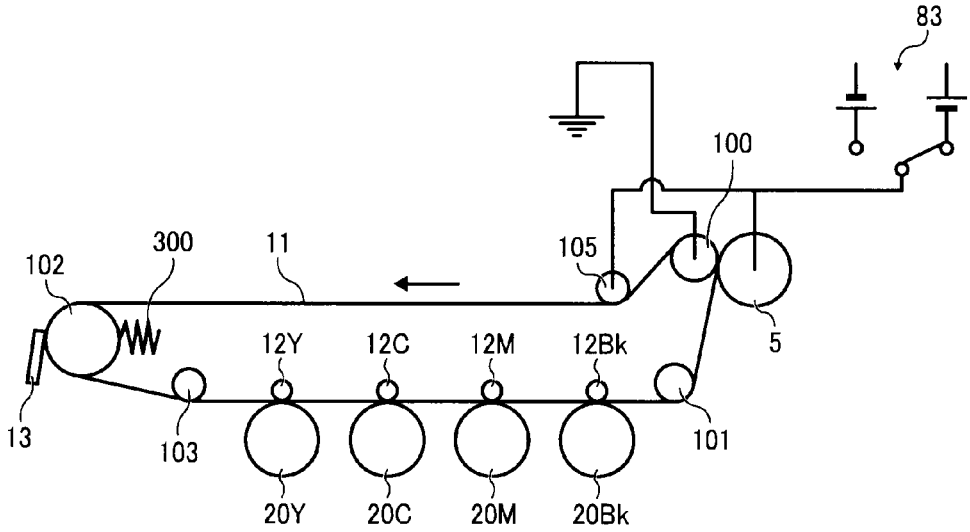
FIG. 7 is a schematic view illustrating a configuration of the transfer unit with a power supply to apply a bias to the surface roller and the driving roller.

Further, by employing a configuration according to any one of the above-described configuration examples, a similar effect is obtained even when a power supply 83 applies a bias to the secondary transfer roller 5 and the surface roller 105 as illustrated in FIG. 7.

In the configuration illustrated in FIG. 7, when a toner image on the intermediate transfer belt 11 is transferred onto a recording sheet P at the secondary transfer nip, the power supply 83 applies a positive bias having a polarity opposite a normal charging polarity of toner to the secondary transfer roller 5 and the surface roller 105.

When the secondary transfer roller 5 and the surface roller 105 are cleaned by electrostatically transferring the toner adhering to the secondary transfer roller 5 and the surface roller 105 onto the intermediate transfer belt 11, the power supply 83 applies a negative bias having a polarity identical to, and a positive bias having a polarity opposite, the normal charging polarity of toner to the secondary transfer roller 5 and the surface roller 105. Specifically, the power supply 83 applies one of the negative and positive biases to the secondary transfer roller 5 and the surface roller 105, switches the one bias to the other bias at a predetermined timing, such as after the surface of the secondary transfer roller 5 is cleaned for a full turn, and applies the other bias to the secondary transfer roller 5 and the surface roller 105.

Next, a description is given of the relation between applied bias and bias application time.

The time period T during which each of the positive and negative biases is applied to the surface roller 105 may be set to satisfy the following formula 6.

$$T>(a\times\pi)/V1 \qquad \text{<Formula 6>}$$

In Formula 6, "a" represents a diameter of the surface roller 105, "π" represents a circle ratio, and "V1" is a moving speed of the intermediate transfer belt 11.

Figure 8:
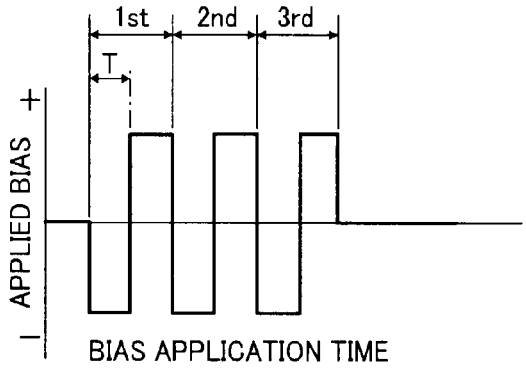
FIG. 8 is a diagram illustrating a relation between bias application time and applied bias.

For example, when the switching of the applied bias is repeated three times as illustrated in FIG. 8, the total bias application time is obtained by T×6. With this application time, the surface roller 105 is more reliably cleaned and rotated in conjunction with the intermediate transfer belt 11.

Figure 9:
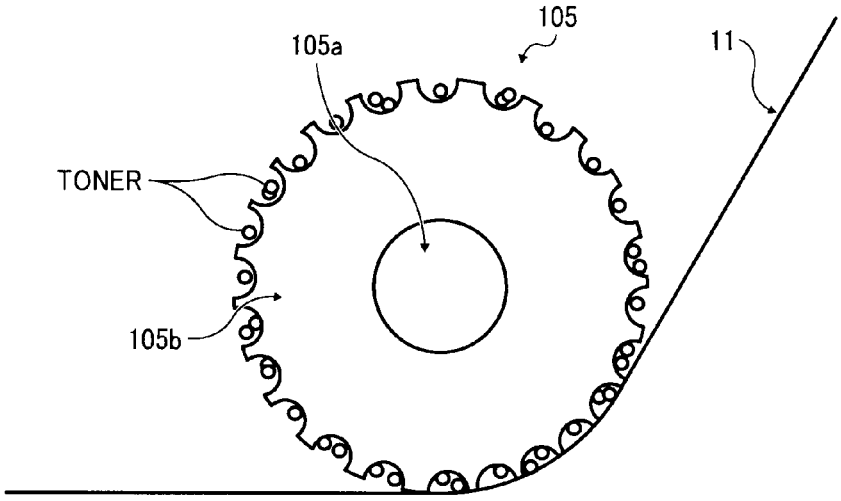
FIG. 9 is a schematic diagram illustrating a configuration of the surface roller according to an illustrative embodiment.

FIG. 9 is a schematic diagram illustrating a configuration of the surface roller 105. In FIG. 9, the surface roller 105 consists of a core metal portion 105*a* and an outer surface portion 105*b* made of, e.g., foamed rubber. The foamed rubber absorbs the toner adhering to the intermediate transfer belt 11 into interior air pockets. As a result, the amount of toner between the intermediate transfer belt 11 and the surface roller 105 decreases, preventing weakening of the frictional force between them. Further, as described above, by applying a bias to the surface roller 105, such absorbed toner is removed from the interior air pockets in preparation for a subsequent toner absorption.

To more reliably rotate the surface roller 105 in conjunction with the intermediate transfer belt 11, the following configuration may be employed.

Figure 10:
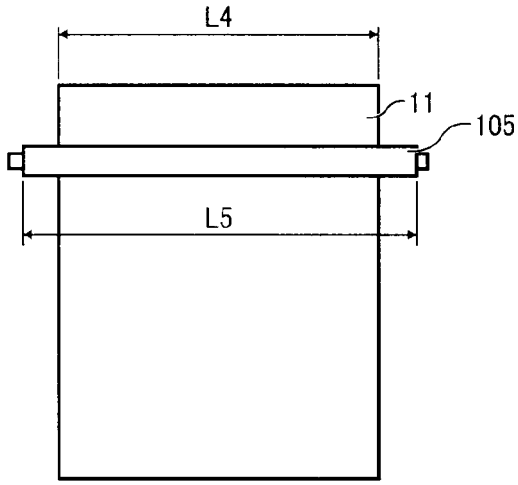
FIG. 10 is a schematic diagram illustrating lengths of the intermediate transfer belt and the surface roller.

FIG. 10 is a schematic configuration illustrating a length of the surface roller 105 and a width of the intermediate transfer belt 11. In FIG. 10, the surface roller 105 is configured so that a width L4 of the intermediate transfer belt 11 (a length in a direction perpendicular to the surface moving direction) and a longitudinal length L5 of the surface roller 105 satisfy the relation L4<L5. Such a configuration allows a bias to be applied across a whole area in the width direction of the intermediate transfer belt 11. That is, an electrostatic attracting force works on the whole area in the width direction of the intermediate transfer belt 11, enhancing the force to rotate the surface roller 105 in conjunction with the intermediate transfer belt 11.

Figure 11:
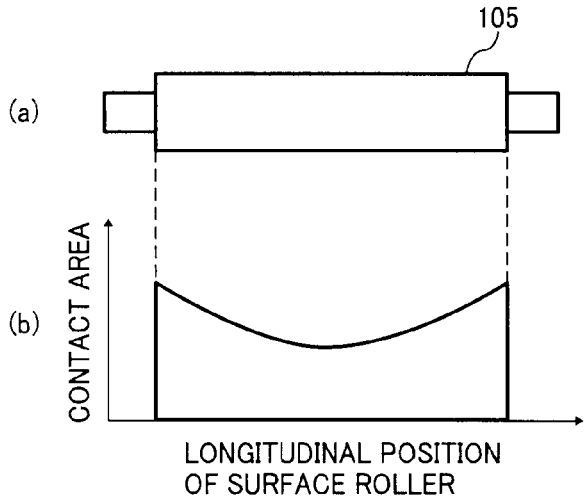
FIG. 11(*a*) is a plan view illustrating a configuration of the surface roller having a straight shape.
Figure 12:
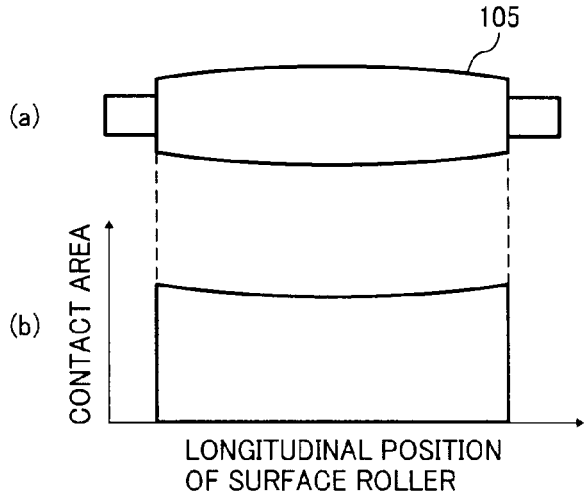
FIG. 12(*a*) is a plan view illustrating a configuration of the surface roller having a crown shape.

FIG. 11(*a*) is a plan view illustrating a configuration of the surface roller 105 having a surface portion formed flat in a longitudinal direction (hereinafter, a "straight shape"), that is, with a constant diameter across its entire axial (longitudinal) width. FIG. 11(*b*) is a diagram illustrating a resultant contact area between the surface roller 105 having the surface portion formed flat in the longitudinal direction, that is, with a constant diameter across its entire axial (longitudinal) width, shown in FIG. 11(*a*), and the intermediate transfer belt 11. FIG. 12(*a*) is a plan view illustrating a configuration of the surface roller 105 having a surface portion in which the outer diameter of a middle portion in the longitudinal direction is formed greater than the outer diameter of each end in the longitudinal direction (hereinafter, a "crown shape"). FIG. 12(*b*) is a diagram illustrating a resultant contact area between the surface roller 105 of increased middle-portion diameter shown in FIG. 12(*a*) and the intermediate transfer belt 11. Generally, the surface roller 105 may be bent by a reaction force of the intermediate transfer belt 11. Accordingly, as illustrated in FIGS. 11(*a*) and 11(*b*), when the surface portion of the surface roller 105 has a straight shape, the contact area between the middle portion of the surface roller 105 and the intermediate transfer belt 11 may decrease. Such a decrease in the contact area between the intermediate transfer belt 11 and the surface roller 105 may weaken the frictional force for rotating the surface roller 105 in conjunction with the intermediate transfer belt 11. Hence, as illustrated in FIGS. 12(*a*) and 12(*b*), the surface portion of the surface roller 105 may be formed in a crown shape, that is, with a middle portion of increased diameter relative to the end portions thereof. Such a configuration suppresses a reduction of the contact area between the intermediate transfer belt 11 and the surface roller 105 when the surface roller 105 is bent, allowing the surface roller 105 to more reliably rotate in conjunction with the intermediate transfer belt 11.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. A transfer unit comprising:

a belt member extended in a loop around a plurality of rollers and having a movable surface on which a toner image is transferred from an image carrier;

a bending roller externally contacting the surface of the belt member to bend the belt member toward an interior of the loop and rotating in conjunction with movement of the surface of the belt member;

a transfer section including one roller of the plurality of rollers and a surface moving member, the one roller located upstream from the bending roller and downstream from a transfer point at which the toner image is transferred from the image carrier onto the surface of the belt member in a surface moving direction of the belt member, the surface moving member facing the one roller of the plurality of rollers via the belt member, the transfer section transferring the toner image from the belt member onto a transfer material at a transfer nip formed as the surface moving member presses against the one roller via the belt member; and an electrical bias application unit to simultaneously apply an electrical bias to both the transfer section and the bending roller to form an electric field to transfer toner adhered to a surface of the surface moving member from the surface moving member onto the belt member and an electric field to transfer toner adhering to a surface of the bending roller from the bending roller onto the belt member, the surface moving member rotating at least one full turn while cleaning is performed on the surface moving member and the bending roller by transferring the toner adhering to the surface of the surface moving member and the surface of the bending roller onto the belt member using the electrical bias applied from the electrical bias application unit to the transfer section and the bending roller, a surface moving speed of the bending roller equal to or greater than a surface moving speed of the surface moving member, a circumferential length L1 of the surface moving member and a circumferential length L2 of the bending roller satisfying the relation L1≥L2, and the surface moving speed of the bending roller is equal to the surface moving speed of the surface moving member, a surface moving distance D1 of the surface moving member in applying the electrical bias from the electrical bias application unit to the transfer section and the bending roller is set to satisfy the relation D1=L1×n, where n is an integer equal to or greater than 2, and the bending roller is located at a position at which a distance L3 from a contact position between the surface moving member and the belt member to a contact position between the bending roller and the belt member toward a downstream side in the surface moving direction of the belt member satisfies one of the relations L3≤(n−1)×L1 and L3≤D1×(n−1)/n, where n is an integer equal to or greater than 2.

2. The transfer unit according to claim 1, wherein the surface moving speed of the bending roller is equal to the surface moving speed of the surface moving member, and L1=L2×n is satisfied where n is an integer equal to or greater than 1.

3. The transfer unit according to claim 1, wherein the electrical bias application unit applies a first electrical bias having a polarity identical to a normal charging polarity of toner to the transfer section and the bending roller.

4. The transfer unit according to claim 1, wherein the electrical bias application unit applies a second electrical bias having a polarity opposite a normal charging polarity of toner to the transfer section and the bending roller.

5. The transfer unit according to claim 1, wherein the bending roller has a surface portion made of a conductive foamed member.

6. The transfer unit according to claim 1, wherein the bending roller has a surface portion made of a conductive rubber member.

7. A transfer unit comprising:

a belt member extended in a loop around a plurality of rollers and having a movable surface on which a toner image is transferred from an image carrier;

a bending roller externally contacting the surface of the belt member to bend the belt member toward an interior of the loop and rotating in conjunction with movement of the surface of the belt member;

a transfer section including one roller of the plurality of rollers and a surface moving member, the one roller located upstream from the bending roller and downstream from a transfer point at which the toner image is transferred from the image carrier onto the surface of the belt member in a surface moving direction of the belt member, the surface moving member facing the one roller of the plurality of rollers via the belt member, the transfer section transferring the toner image from the belt member onto a transfer material at a transfer nip formed as the surface moving member presses against the one roller via the belt member; and an electrical bias application unit to simultaneously apply an electrical bias to both the transfer section and the bending roller to form an electric field to transfer toner adhered to a surface of the surface moving member from the surface moving member onto the belt member and an electric field to transfer toner adhering to a surface of the bending roller from the bending roller onto the belt member, the surface moving member rotating at least one full turn while cleaning is performed on the surface moving member and the bending roller by transferring the toner adhering to the surface of the surface moving member and the surface of the bending roller onto the belt member using the electrical bias applied from the electrical bias application unit to the transfer section and the bending roller, a surface moving speed of the bending roller equal to or greater than a surface moving speed of the surface moving member, a circumferential length L1 of the surface moving member and a circumferential length L2 of the bending roller satisfying the relation L1≥L2, and the electrical bias application unit switches between a first electrical bias having a polarity identical to a normal charging polarity of toner and a second electrical bias having a polarity opposite a normal charging polarity of toner, and applies the first electrical bias and the second electrical bias to the surface moving member and the bending roller.

8. The transfer unit according to claim 7, wherein the electrical bias application unit switches between the first electrical bias and the second electrical bias and applies the first electrical bias and the second electrical bias to the surface moving member and the bending roller multiple times.

9. The transfer unit according to claim 7, wherein the electrical bias application unit applies one of the first electrical bias and the second electrical bias while the bending roller rotates at least one full turn.

10. The transfer unit according to claim 7, wherein the surface moving speed of the bending roller is equal to the surface moving speed of the surface moving member, and L1=L2×n is satisfied where n is an integer equal to or greater than 1.

11. The transfer unit according to claim 7, wherein the bending roller has a surface portion made of a conductive foamed member.

12. The transfer unit according to claim 7, wherein the bending roller has a surface portion made of a conductive rubber member.

13. A transfer unit comprising:

a belt member extended in a loop around a plurality of rollers and having a movable surface on which a toner image is transferred from an image carrier;

a bending roller externally contacting the surface of the belt member to bend the belt member toward an interior of the loop and rotating in conjunction with movement of the surface of the belt member;

a transfer section including one roller of the plurality of rollers and a surface moving member, the one roller located upstream from the bending roller and downstream from a transfer point at which the toner image is transferred from the image carrier onto the surface of the belt member in a surface moving direction of the belt member, the surface moving member facing the one roller of the plurality of rollers via the belt member, the transfer section transferring the toner image from the belt member onto a transfer material at a transfer nip formed as the surface moving member presses against the one roller via the belt member; and an electrical bias application unit to simultaneously apply an electrical bias to both the transfer section and the bending roller to form an electric field to transfer toner adhered to a surface of the surface moving member from the surface moving member onto the belt member and an electric field to transfer toner adhering to a surface of the bending roller from the bending roller onto the belt member, the surface moving member rotating at least one full turn while cleaning is performed on the surface moving member and the bending roller by transferring the toner adhering to the surface of the surface moving member and the surface of the bending roller onto the belt member using the electrical bias applied from the electrical bias application unit to the transfer section and the bending roller, a surface moving speed of the bending roller equal to or greater than a surface moving speed of the surface moving member, a circumferential length L1 of the surface moving member and a circumferential length L2 of the bending roller satisfying the relation L1≥L2, and the bending roller has a crown shape in which a diameter of a middle portion in an axial direction of the bending roller is greater than a diameter of each end portion in the axial direction, the surface of the bending roller includes pockets that absorb toner adhered to the surface of the belt member, and absorbed toner is removed from the pockets by the electric field that transfers toner from the bending roller.

14. The transfer unit according to claim 13, wherein the surface moving speed of the bending roller is equal to the surface moving speed of the surface moving member, and L1=L2×n is satisfied where n is an integer equal to or greater than 1.

15. The transfer unit according to claim 13, wherein the bending roller has a surface portion made of a conductive foamed member.

16. The transfer unit according to claim 13, wherein the bending roller has a surface portion made of a conductive rubber member.

17. An image forming apparatus, comprising:

an image carrier to carry a toner image;

an intermediate transfer belt extended in a loop around a plurality of rollers and having a surface on which the toner image is transferred from the image carrier at a primary transfer nip formed by the image carrier and the intermediate transfer belt;

a bending roller externally contacting the surface of the intermediate transfer belt to bend the intermediate transfer belt toward an interior of the loop and rotating in conjunction with movement of the surface of the intermediate transfer belt;

a secondary transfer member contacting the surface of the intermediate transfer belt and transferring the toner image from the intermediate transfer belt onto a transfer material at a secondary transfer nip formed by the secondary transfer member and the intermediate transfer belt; and an electrical bias application unit configured to apply to the bending roller an electrical bias having a polarity to electrostatically adhere the intermediate transfer belt to the bending roller, wherein the bending roller has a surface portion made of a conductive elastic member and has a crown shape in which a diameter of a middle portion in an axial direction of the bending roller is greater than a diameter of each end portion in the axial direction, the surface of the bending roller includes pockets that absorb toner adhered to the surface of the intermediate transfer belt, and absorbed toner is removed from the pockets by an electric field that transfers toner from the bending roller.

18. The image forming apparatus according to claim 17, wherein a width L4 of the intermediate transfer belt in a direction perpendicular to a surface moving direction and a longitudinal length L5 of the bending roller satisfy the relation L4<L5.

19. The image forming apparatus according to claim 17, wherein the bending roller has a surface portion made of a conductive foamed member.

20. The image forming apparatus according to claim 17, wherein the bending roller has a surface portion made of a conductive rubber member.

21. The image forming apparatus according to claim 17, wherein the electrical bias application unit switches between a first electrical bias having a polarity identical to a normal charging polarity, of toner and a second electrical bias having a polarity opposite a normal charging polarity of toner, and applies the first electrical bias and the second electrical bias to a surface moving member and the bending roller.

22. The image forming apparatus according to claim 21, wherein the electrical bias application unit switches between the first electrical bias and the second electrical bias and applies the first electrical bias and the second electrical bias to the surface moving member and the bending roller multiple times.

23. The image forming apparatus according to claim 21, wherein the electrical bias application unit applies one of the first electrical bias and the second electrical bias while the bending roller rotates at least one full turn.

24. The image forming apparatus according to claim 17, wherein the bending roller is disposed downstream from the secondary transfer nip and upstream from the primary transfer nip in a surface moving direction of the intermediate transfer belt.

25. The image forming apparatus according to claim 24, wherein the plurality of rollers include a tension roller providing the intermediate transfer belt with tension, and the tension roller is disposed downstream from a position where the bending roller contacts the surface of the intermediate transfer belt and upstream from the primary transfer nip in the surface moving direction of the intermediate transfer belt.

26. The image forming apparatus according to claim 25, further comprising:

a belt cleaner configured to remove a residual toner from the surface of the intermediate transfer belt, wherein the belt cleaner is disposed opposing the tension roller via the intermediate transfer belt.

27. A transfer unit comprising:

a belt member extended in a loop around a plurality of rollers and having a movable surface on which a toner image is transferred from an image carrier;

a bending roller externally contacting the surface of the belt member to bend the belt member toward an interior of the loop and rotating in conjunction with movement of the surface of the belt member;

a transfer section including one roller of the plurality of rollers and a surface moving member, the one roller located upstream from the bending roller and downstream from a transfer point at which the toner image is transferred from the image carrier onto the surface of the belt member in a surface moving direction of the belt member, the surface moving member facing the one roller of the plurality of rollers via the belt member, the transfer section transferring the toner image from the belt member onto a transfer material at a transfer nip formed as the surface moving member presses against the one roller via the belt member; and an electrical bias application unit to simultaneously apply an electrical bias to both the transfer section and the bending roller to form an electric field to transfer toner adhered to a surface of the surface moving member from the surface moving member onto the belt member and an electric field to transfer toner adhering to a surface of the bending roller from the bending roller onto the belt member, the surface moving member rotating at least one full turn while cleaning is performed on the surface moving member and the bending roller by transferring the toner adhering to the surface of the surface moving member and the surface of the bending roller onto the belt member using the electrical bias applied from the electrical bias application unit to the transfer section and the bending roller, a surface moving speed of the bending roller equal to or greater than a surface moving speed of the surface moving member, a circumferential length L1 of the surface moving member and a circumferential length L2 of the bending roller satisfying the relation L1≥L2, the bending roller has a metal core portion made of a metal and a surface portion made of a conductive elastic member formed around the metal core portion and has a crown shape in which the surface portion has a greater thickness at a middle portion in an axial direction of the bending roller than at each end portion in the axial direction, and the electrical bias application unit applies the electrical bias for a finite time period T in a cycle satisfying a relation $T>(a\times\pi)/V$, where a is a diameter of the bending roller, $\pi$ is a circle ratio, and V is a surface moving speed of the belt member, and the electrical bias application unit changes a polarity of the electrical bias at a frequency equal to $1/(2\times T)$.

28. An image forming apparatus, comprising:

an image carrier to carry a toner image;

an intermediate transfer belt extended in a loop around a plurality of rollers and having a surface on which the toner image is transferred from the image carrier at a primary transfer nip formed by the image carrier and the intermediate transfer belt;

a bending roller externally contacting the surface of the intermediate transfer belt to bend the intermediate transfer belt toward an interior of the loop and rotating in conjunction with movement of the surface of the intermediate transfer belt;

a secondary transfer member contacting the surface of the intermediate transfer belt and transferring the toner image from the intermediate transfer belt onto a transfer material at a secondary transfer nip formed by the secondary transfer member and the intermediate transfer belt; and an electrical bias application unit configured to apply to the bending roller an electrical bias having a polarity to electrostatically adhere the intermediate transfer belt to the bending roller, wherein the bending roller has a metal core portion made of a metal and a surface portion made of a conductive elastic member formed around the metal core portion and has a crown shape in which the surface portion has a greater thickness at a middle portion in an axial direction of the bending roller than at each end portion in the axial direction, and the electrical bias application unit applies the electrical bias for a finite time period T in a cycle satisfying a relation $T>(a\times\pi)/V$, where a is a diameter of the bending roller, $\pi$ is a circle ratio, and V is a surface moving speed of the intermediate transfer belt, and the electrical bias application unit changes a polarity of the electrical bias at a frequency equal to $1/(2\times T)$.

29. The image forming apparatus according to claim 17, wherein the plurality of rollers includes an entry roller, and the entry roller is disposed downstream from the primary transfer nip and upstream from the secondary transfer nip in a surface moving direction of the intermediate transfer belt.

* * * * *